US009085742B2

(12) United States Patent
Iwai

(10) Patent No.: US 9,085,742 B2
(45) Date of Patent: Jul. 21, 2015

(54) LUBRICANT COMPOSITION FOR CONTINUOUSLY VARIABLE TRANSMISSION

(75) Inventor: Toshiaki Iwai, Ichihara (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 12/867,521

(22) PCT Filed: Jan. 22, 2009

(86) PCT No.: PCT/JP2009/050921

§ 371 (c)(1),
(2), (4) Date: Aug. 13, 2010

(87) PCT Pub. No.: WO2009/101847

PCT Pub. Date: Aug. 20, 2009

(65) Prior Publication Data

US 2010/0317551 A1 Dec. 16, 2010

(30) Foreign Application Priority Data

Feb. 13, 2008 (JP) ..... 2008-031527

(51) Int. Cl.
*C10M 169/00* (2006.01)
*C10M 163/00* (2006.01)

(52) U.S. Cl.
CPC ..... *C10M 163/00* (2013.01); *C10M 169/00* (2013.01); *C10M 2203/1025* (2013.01); *C10M 2207/028* (2013.01); *C10M 2207/26* (2013.01); *C10M 2207/262* (2013.01); *C10M 2215/064* (2013.01); *C10M 2215/086* (2013.01); *C10M 2215/28* (2013.01); *C10M 2219/046* (2013.01); *C10M 2219/089* (2013.01); *C10M 2223/04* (2013.01); *C10M 2223/041* (2013.01); *C10M 2223/047* (2013.01); *C10M 2229/02* (2013.01); *C10N 2210/02* (2013.01); *C10N 2220/02* (2013.01); *C10N 2220/04* (2013.01); *C10N 2230/02* (2013.01); *C10N 2230/06* (2013.01); *C10N 2240/045* (2013.01); *C10N 2240/046* (2013.01); *C10N 2260/14* (2013.01)

(58) Field of Classification Search
USPC ..... 508/185, 287, 421, 336, 586
See application file for complete search history.

(56) References Cited

U.S. PATENT DOCUMENTS 5,792,731 A * 8/1998 Ichihashi et al. ..... 508/322
2003/0181339 A1 9/2003 Watts et al.
2004/0192562 A1* 9/2004 Morita ..... 508/185
2004/0204325 A1* 10/2004 Takahashi ..... 508/186
2006/0135378 A1 6/2006 Takahashi et al.
2007/0191239 A1* 8/2007 Matsuoka et al. ..... 508/465
2007/0287643 A1 12/2007 Matsui et al.

FOREIGN PATENT DOCUMENTS

| | | | |
|---|---|---|---|
| EP | 0 805 194 | | 11/1997 |
| EP | 1 344 814 | A1 | 9/2003 |
| EP | 1 598 412 | A1 | 11/2005 |
| JP | 9 100487 | | 4/1997 |
| JP | 9 202890 | | 8/1997 |
| JP | 2007 126543 | | 5/2007 |
| JP | 2007 326963 | | 12/2007 |
| WO | 03 031544 | | 4/2003 |
| WO | 03 038018 | | 5/2003 |
| WO | 2008 016038 | | 2/2008 |

OTHER PUBLICATIONS

Extended European Search Report issued Feb. 22, 2012 in patent application No. 09710374.1.
Office Action issued Dec. 3, 2012, in corresponding European Patent Application No. 09710374.1.

* cited by examiner

*Primary Examiner* — Taiwo Oladapo
(74) *Attorney, Agent, or Firm* — Oblon, McClelland, Maier & Neustadt, L.L.P.

(57) ABSTRACT

A lubricating oil composition for a continuously variable transmission according to the invention includes: a base oil of lubricating oil; components (A) to (C) below:

(A) an acidic phosphorus compound expressed by a formula (1) below, (1)

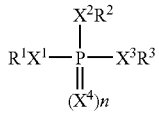

where: $R^1$, $R^2$ and $R^3$ each independently represent hydrogen or an alkyl group having 8 or less carbon atoms, $R^1$, $R^2$ and $R^3$ being not simultaneously hydrogen nor the alkyl group, $X^1$, $X^2$, $X^3$ and $X^4$ each represent oxygen or sulfur, and n represents zero or one, in which when n is zero, at least two of $X^1$, $X^2$ and $X^3$ are sulfur and when n is one, at least two of $X^1$, $X^2$, $X^3$ and $X^4$ are sulfur;

(B) an imide compound; and (C) an alkaline earth metal salt.

7 Claims, No Drawings

LUBRICANT COMPOSITION FOR CONTINUOUSLY VARIABLE TRANSMISSION

This application is a 371 of PCT/JP2009/050921 filed Jan. 22, 2009.

TECHNICAL FIELD

The present invention relates to a lubricating oil composition for a continuously variable transmission.

BACKGROUND ART

In a continuously variable transmission, it has been well known to use friction between a metal belt or chain and a pulley made of metal to transmit torque. A lubricating oil used for such a continuously variable transmission is required to have a high power (torque) transmission capacity. Accordingly, there have been known various kinds of lubricating oil compositions with a large power transmission capacity enough to allow a favorable power transmission (e.g., see Patent Documents 1 and 2).

A lubricating oil composition disclosed in Patent Document 1 is excellent in abrasion resistance and extreme pressure property and is capable of maintaining a high friction coefficient for a long time. In order to transmit a large amount of torque, this lubricating oil composition is formed by adding a base oil of lubricating oil with a sulfuric extreme pressure agent, a phosphorus extreme pressure agent and an alkali earth metal detergent.

A lubricating oil composition disclosed in Patent Document 2 is formed by adding a base oil of lubricating oil with an effective amount of succinic bisimide having a predetermined structure in order to increase the power transmission capacity of the lubricating oil composition and to improve the anti-shudder property thereof.

In a lubricating oil composition disclosed in Patent Document 3, a sulfonate detergent and boron-containing succinimide are mixed, thereby improving the torque transmission capacity of the lubricating oil composition and the antiwear property of a wet-type friction agent.

[Patent Document 1] JP-A-9-100487

[Patent Document 2] JP-A-9-202890

[Patent Document 3] JP-A-2007-126543

DISCLOSURE OF THE INVENTION

Problems to be Solved by the Invention

What is important for a clutch for a continuously variable transmission is not only a high friction coefficient between metals that represents an index of torque transmission capacity in engagement but also seizure resistance between metals.

However, with the lubricating oil compositions of the above Patent Documents 1 to 3, a sufficient clutch property has not yet been exhibited. The lubricating oil compositions, which are blended for simply increasing friction coefficient between metals, exhibit a lowered seizure resistance.

Further, these conventional lubricating oil compositions, even though being applicable to a belt-type continuously variable transmission requiring less-restricted use conditions, are likely to cause seizure when being used for a chain-type continuously variable transmission having a larger contacting pressure.

Accordingly, it is an object of the invention to provide a lubricating oil composition for a continuously variable transmission, capable of providing a high torque transmission capacity (friction coefficient between metals) and seizure resistance when a clutch is in engagement.

Means for Solving the Problems

In order to solve the above problems, according to an aspect of the invention, lubricating oil compositions as follows are provided.

[1] A lubricating oil composition for a continuously variable transmission including: a base oil of lubricating oil; components (A) to (C) below:

(A) an acidic phosphorus compound expressed by a formula (1) below,

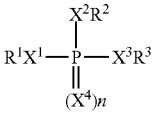

(1)

where: $R^1$, $R^2$ and $R^3$ each independently represent hydrogen or an alkyl group having 8 or less carbon atoms, $R^1$, $R^2$ and $R^3$ being not simultaneously hydrogen nor the alkyl group, $X^1$, $X^2$, $X^3$ and $X^4$ each represent oxygen or sulfur, and n represents zero or one, in which when n is zero, at least two of $X^1$, $X^2$ and $X^3$ are sulfur and when n is one, at least two of $X^1$, $X^2$, $X^3$ and $X^4$ are sulfur;

(B) an imide compound; and (C) an alkaline earth metal salt.

[2] The above lubricating oil composition, in which the component (A) is acid dithiophosphate and/or acid dithiophosphite.

[3] The above lubricating oil composition, in which the component (A) is added to a base oil of lubricating oil at 0.05 to 0.5 mass % relative to a total amount of the composition.

[4] The above lubricating oil composition, in which the component (B) is a boron-modified imide compound.

[5] The above lubricating oil composition, in which the boron-modified imide compound is succinimide having an alkyl or alkenyl group whose number average molecular weight is in a range from 600 to 3000.

[6] The above lubricating oil composition, in which the compound (B) is added in an amount of 0.01 to 0.03 mass % in terms of boron relative to a total amount of the composition.

[7] The above lubricating oil composition, in which the component (C) is at least one compound of alkaline earth metal salicylate, alkaline earth metal sulfonate and alkaline earth metal phenate.

[8] The above lubricating oil composition, in which a total base number of the component (C) is in a range from 100 to 500 mgKOH/g.

[9] The above lubricating oil composition, in which the component (C) is added to the base oil of the lubricating oil in an amount of 0.01 to 0.05 mass % in terms of alkaline earth metal relative to a total amount of the composition.

[10] The above lubricating oil composition, in which the composition exhibits properties (D) to (F) below:

(D) kinematic viscosity at 40 degrees C. of 20 to 40 $mm^2/s$;

(E) kinematic viscosity at 100 degrees C. of 4 to 8 $mm^2/s$; and (F) viscosity index of 100 to 250.

Since the base oil is added with three specific components in the lubricating oil composition according to the aspect of the invention, the friction coefficient between metals is high and thus the torque transmission capacity is high. The seizure resistance between metals is also excellent. Accordingly, the lubricating oil composition according to the aspect of the invention is preferably used for a belt-type continuously variable transmission particularly with a metal belt.

BEST MODE FOR CARRYING OUT THE INVENTION

A preferred exemplary embodiment for implementing the invention will be described below.

[Formation of Lubricating Oil Composition]

A lubricating oil composition for a continuously variable transmission of the invention is formed by adding a base oil of lubricating oil with (A) an acidic phosphorus compound, (B) an imide compound and (C) an alkaline earth metal salt. A detailed description thereof will be made below.

Base Oil of Lubricating Oil

As a base oil of lubricating oil, at least one of mineral oil and synthetic oil may be respectively used singularly or in a combination of two or more. Alternatively, a combination of the mineral oil and the synthetic oil may be used.

There is no specific limitation on the mineral oil and the synthetic oil and thus any oils generally used as a base oil for a transmission are applicable. Particularly, a kinematic viscosity at 100 degrees C. is preferably in a range from 1 $mm^2/s$ to 50 $mm^2/s$, particularly, in a range from 2 $mm^2/s$ to 15 $mm^2/s$. When the kinematic viscosity is extremely high, a low-temperature viscosity may be deteriorated. When the kinematic viscosity is extremely low, abrasion of sliding portions such as a gear bearing and a clutch of a continuously variable transmission may be increased. Accordingly, the base oil of lubricating oil having a kinematic viscosity at 100 degrees C. of 1 $mm^2/s$ or more but 50 $mm^2/s$ or less, particularly, 2 $mm^2/s$ or more but 15 $mm^2/s$ or less, are preferably used as the base oil of lubricating oil.

A pour point that represents an index of low-temperature fluidity of the base oil of lubricating oil is not particularly limited but is preferably minus 10 degrees C. or less, particularly, minus 15 degrees C. or less.

The base oil of lubricating oil is not particularly limited, but it is preferable that the content of saturated hydrocarbon thereof is 90 mass % or more, the content of sulfur thereof is 0.03 mass % or less and the viscosity index thereof is 100 or more. Here, when the content of saturated hydrocarbon is less than 90 mass %, deterioration products may be disadvantageously increased. When the content of sulfur is more than 0.03 mass %, deterioration products may be disadvantageously increased. When the viscosity index is smaller than 100, abrasion at a high temperature may be disadvantageously increased. Accordingly, the mineral oil and the synthetic oil whose content of saturated hydrocarbon is 90 mass % or more, content of sulfur is 0.03 mass % or less and viscosity index is 100 or more are preferably used.

Examples of such mineral oil are naphthenic mineral oil, paraffinic mineral oil and GTL WAX. Specifically, such mineral oil is exemplified by light neutral oil, medium neutral oil, heavy neutral oil and bright stock that are produced by solvent purification or hydrogenation purification.

Examples of the synthetic oil are polybutene or a hydride thereof, polyalphaolefin (such as 1-octene oligomer and 1-decene oligomer), alphaolefin copolymer, alkylbenzene, polyol ester, diacid ester, polyoxyalkylene glycol, polyoxyalkylene glycol ester, polyoxyalkylene glycol ether, hindered ester and silicone oil.

Component (A): Acidic Phosphorus Compound

A component (A) contained in the lubricating oil composition for a continuously variable transmission of the invention is acidic phosphorus compound expressed by a formula (1) below.

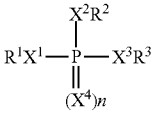

(1)

In the formula, $R^1$, $R^2$ and $R^3$ respectively represent hydrogen or an alkyl group having 8 or less carbon atoms. Here, in the case where $R^1$, $R^2$ or $R^3$ represents the alkyl group, when the alkyl group has 9 or more carbon atoms, the friction coefficient of the lubricating oil composition is likely to be decreased. It should be noted that all of $R^1$, $R^2$ and $R^3$ are not simultaneously hydrogen or the alkyl group. When all of $R^1$, $R^2$ and $R^3$ are the alkyl group, so-called neutral ester phosphate is formed. The neutral ester phosphate is not preferable in view of friction coefficient between metals and seizure resistance.

$X^1$, $X^2$, $X^3$ and $X^4$ represent oxygen or sulfur. n represents zero or one. When n is zero, at least two of $X^1$, $X^2$ and $X^3$ are sulfur. When n is one, at least two of $X^1$, $X^2$, $X^3$ and $X^4$ are sulfur. In either case where n is zero or one, when there is one or zero sulfur atom to be boded to phosphorus (P) contained in the compound, the seizure resistance of the lubricating oil composition is poor.

As such acidic phosphorus compound, a compound known as an extreme pressure agent can be used. Specifically, acid dithiophosphate ester or acid dithiophosphite are preferable in view of solubility to the base oil of lubricating oil and seizure resistance. For instance, the acid dithiophosphate is preferably a compound expressed by a formula (2) below.

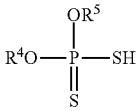

(2)

In the formula, each of $R^4$ and $R^5$ is hydrogen or an alkyl group having 8 or less carbon atoms. It should be noted that both are not simultaneously hydrogen. The acid dithiophosphate of the above formula (2) is preferably di(2-ethylhexyl) dithiophosphate in view of seizure resistance. This compound is available as Phoslex DT-8 manufactured by Sakai Chemical Industry, Co., Ltd.

The content of the component (A) is preferably 0.05 to 0.5 mass % relative to the total amount of the composition, more preferably 0.05 to 0.4 mass %, further preferably 0.1 to 0.3 mass %. When the content of the component (A) is 0.05 mass % or more, a sufficient seizure resistance can be exhibited. In view of oxidation stability, the content of the component (A) is preferably 0.5 mass % or less.

Component (B): Imide Compound

An imide compound as a component (B) contained in the lubricating oil composition of the invention is preferably succinimide, which is effective in improvement of friction coefficient between metals and thus excellent in anti-shudder property. Particularly, the succinimide preferably has an alkyl or alkenyl group with a number average molecular weight of 600 to 3000 in a side chain. There are various examples of such succinimide, e.g., succinimide having a polybutenyl or polybutenyl group. Here, the polybutenyl group is obtained by polymerizing 1-butene with an isobutene mixture or a high-purity isobutene or by hydrogenerating with a polyisobutenyl group. Incidentally, the succinimide may be so-called monotype alkenyl or alkyl succinimide, or so-called bis-type alkenyl or alkyl succinimide. The succinimide may be selected for use from compounds known as an ashless dispersant.

Any conventional method may be employed to produce the succinimide having a side chain. For instance, polybutene or chlorinated polybutene whose number average molecular weight is approximately 600 to 3000 and anhydride maleic acid are reacted with each other at approximately 100 to 200 degrees C., and then its reaction product, i.e. polybutenyl succinic acid, is reacted with polyamine to obtain polybutenyl succinimide.

Examples of the polyamine are diethylene triamin, triethylene tetramine, tetraethylene pentamine and pentaethylene hexamine.

The alkenyl or alkyl succinimide and an aromatic compound such as alkylphenol or sulfurized alkylphenol can be subjected to Mannich condensation to obtain an alkylphenol or sulfurized alkylphenol derivative, which is also preferably used. In this case, alkylphenol having an alkyl group of 3 to 30 carbon atoms is typically used.

In such succinimide having the alkyl or alkenyl group whose number average molecular weight is 600 to 3000 in the side chain, when the number average molecular weight of the side chain is less than 600, dispersibility to the base oil is unfavorably deteriorated. On the other hand, when the number average molecular weight of the side chain exceeds 3000, handlability in preparation of the lubricating oil composition is deteriorated. Moreover, the viscosity of the composition is extremely increased, so that a friction property of a clutch (e.g., a wet-type clutch) to which the composition is applied may be deteriorated.

The above-described succinimide is preferably boron-modified. For instance, by adding the above-described polyamine and polybutenyl succinic acid (anhydride) and a boron compound such as boracic acid to an organic solvent such as alcohol, hexane or xylene and applying heat thereto under an appropriate condition, a boronated polybutenyl succinimide is obtained. Incidentally, examples of the boron compound other than boracic acid are boric anhydride, boron halogenide, borate ester, borate amide and boric oxide. Among the above, boracic acid is particularly preferable.

Such boron-modified succinimide, which has a bulky structure, is preferable because addition thereof to the compound allows an increase in the friction coefficient between metals, which results in an increase in the torque transmission capacity.

When the above-described boron-modified succinimide is added, the content of boron relative to the total amount of the composition is preferably in a range from 0.01 to 0.03 mass %, more preferably in a range from 0.015 to 0.025 mass %. When the boron-modified succinimide is added, the content of boron is preferably 0.01 mass % or more in view of improvement in the friction coefficient between metals and the content of boron is preferably 0.03 mass % or less in view of prevention of clogging of a clutch member. When the content of boron is 0.01 mass % or more, heat resistance of the lubricating oil composition is improved.

When the content of boron is 0.03 mass % or less, hydrolysis of boron can be suppressed and production cost can be suppressed, which is preferable.

Component (C): Alkaline Earth Metal Salt

As alkaline earth metal salt as a component (C) contained in the lubricating oil composition for a continuously variable transmission of the invention, at least one compound of alkaline earth metal salicylate, alkaline earth metal sulfonate and alkaline earth metal phenate is preferably used. These compounds may also be selected for use from compounds known as a metal detergent.

The alkaline earth metal salicylate is exemplified by an alkaline earth metal salt of alkyl salicylic acid, particularly a magnesium salt and a calcium salt, among which the calcium salt is preferably used.

The alkaline earth metal sulfonate is exemplified by an alkaline earth metal salt of alkyl aromatic sulfonic acid, particularly a magnesium salt and a calcium salt, among which the calcium salt is preferably used. Such alkaline earth metal salt of alkyl aromatic sulfonic acid is obtained by sulfonating an alkyl aromatic compound whose molecular weight is 300 to 1500 (preferably 400 to 700).

The alkaline earth metal phenate is exemplified by alkylphenol, an alkylphenol sulfide and alkaline earth metal salt as a Mannich reaction product of alkylphenol, particularly a magnesium salt and a calcium salt, among which the calcium salt is preferably used.

An alkyl group forming the alkaline earth metal salt preferably has 4 to 30 carbon atoms. The alkyl group is more preferably a linear or branched alkyl group having 6 to 18 carbon atoms. The alkyl group may be a primary alkyl group, a secondary alkyl group or a tertiary alkyl group.

In addition, the alkaline earth metal salicylate, the alkaline earth metal sulfonate and the alkaline earth metal phenate may be neutral alkaline earth metal sulfonate, neutral alkaline earth metal phenate and neutral alkaline earth metal salicylate obtained by: directly reacting the above-described alkylphenol, alkylphenol sulfide, a Mannich reaction product of alkylphenol, alkyl salicylic acid, alkyl aromatic sulfonic acid or the like with alkaline earth metal base exemplified by an oxide or a hydroxide of alkaline earth metal such as magnesium and/or calcium; or converting the above-described substance into alkali metal salt such as sodium salt or potassium salt and subsequently substituting the alkali metal salt with alkaline earth metal salt. Alternatively, alkaline earth metal sulfonate, alkaline earth metal phenate and alkaline earth metal salicylate may be: basic alkaline earth metal sulfonate, basic alkaline earth metal phenate and basic alkaline earth metal salicylate obtained by heating neutral alkaline earth metal sulfonate, neutral alkaline earth metal phenate and neutral alkaline earth metal salicylate with excess alkaline earth metal salt or alkaline earth metal base under the presence of water; or overbased alkaline earth metal sulfonate, overbased alkaline earth metal phenate and overbased alkaline earth metal salicylate obtained by reacting neutral alkaline earth metal sulfonate, neutral alkaline earth metal phenate and neutral alkaline earth metal salicylate with carbonate or borate of alkaline earth metal under the presence of carbon dioxide gas.

In these alkaline earth metal salts, the total base number (TBN) thereof is preferably in a range from 100 to 500 mgKOH/g, more preferably in a range from 200 to 400 mgKOH/g. When the total base number is less than 100 mgKOH/g, oxidation stability may be deteriorated. On the other hand, when the total base number exceeds 500 mgKOH/g, a neutralization number thereof may be unbalanced, thereby deteriorating seizure resistance.

The content of the above-described component (C) is preferably in a range from 0.01 to 0.05 mass % in terms of alkaline earth metal relative to the total amount of the composition, more preferably in a range from 0.015 to 0.45 mass %, further preferably in a range from 0.02 to 0.04 mass %. The content of the component (C) of 0.01 mass % or more is preferable in view of the friction coefficient between metals and the content of the component (C) of 0.05 mass % or less is preferable in view of prevention of clogging of the clutch member.

The lubricating oil composition for a continuously variable transmission of the invention preferably has the following properties (D) to (F).

(D) kinematic viscosity at 40 degrees C.: 20 to 40 $mm^2/s$ (E) kinematic viscosity at 100 degrees C.: 4 to 8 $mm^2/s$ (F) viscosity index: 100 to 250

When the kinematic viscosity at 40 degrees C. is 20 $mm^2/s$ or more, the composition exhibits a high oil film sustainability. When the kinematic viscosity at 40 degrees C. is 40 $mm^2/s$ or less, the composition is preferable in view of saving-fuel performance. The kinematic viscosity at 40 degrees C. is more preferably in a range from 25 to 38 $mm^2/s$.

When the kinematic viscosity at 100 degrees C. is 4 $mm^2/s$ or more, the lubricating oil exhibits oil film sustainability enough to overcome evaporation loss of the base oil of lubricating oil. On the other hand, the kinematic viscosity at 100 degrees C. of 8 $mm^2/s$ or less serves to favorably maintain low-temperature viscosity property. In addition such kinematic viscosity is preferable in view of maintaining the friction coefficient between metals. The kinematic viscosity at 100 degrees C. is more preferably in a range from 5 to 6 $mm^2/s$.

When the viscosity index is 100 or more, temperature-dependency of the viscosity of the composition is small, and thus lubricating oil composition for a continuously variable transmission of the invention can be stably used in a range from a low temperature to a high temperature. On the other hand, when an additive amount of a viscosity index improver is increased until the viscosity index exceeds 250, shear stability may be deteriorated.

In order to improve the viscosity index, addition of a viscosity index improver is preferable. As the viscosity index improver, for instance, polymethacrylate, an olefin-based copolymer such as an ethylene-propylene copolymer, a dispersed olefin-based copolymer, and a styrene-based copolymer such as a styrene-diene copolymer hydride are respectively used singularly or in a combination of two or more. The viscosity index improver is preferably added at a rate of 0.01 to 10 mass % relative to the total amount of the composition.

Since the above-described lubricating oil composition for a continuously variable transmission of the invention has the large torque transmission capacity due to the high friction coefficient between metals and is excellent in seizure resistance, the lubricating oil composition may be applied to various types of continuously variable transmissions such as a chain-type continuously variable transmission with a chain and a belt-type continuously variable transmission with a metal belt.

Other Additives

The lubricating oil composition of the invention may be added as necessary with various additives as long as the object of the invention is not hampered.

As the additives, for instance, an antioxidant, an antiwear agent, a metal deactivator, an antifoaming agent, a pour point depressant, a surfactant, a coloring agent and the like are used as necessary.

The antioxidant may be exemplified by an amine-based antioxidant, a phenol-based antioxidant, a sulfur-based antioxidant and the like.

Examples of the amine-based antioxidant are: an antioxidant based on monoalkyldiphenylamine such as monooctyldiphenylamine and monononyldiphenylamine; an antioxidant based on dialkyl diphenylamine such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; an antioxidant based on polyalkyldiphenylamine such as tetrabutyldiphenylamine, tetrahexyldiphenylamine, tetraoctyldiphenylamine and tetranonyldiphenylamine; and an antioxidant based on naphthylamine such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine. Particularly, a compound having an alkyl group of 4 to 24 carbon atoms, particularly 6 to 18 carbon atoms, is preferably used. One or a combination of two or more of the above compounds may be used.

Examples of the phenol-based antioxidant are: 2,6-di-t-butylphenol; 2,6-di-t-butyl-4-methylphenol; 4,4'-methylenebis(2,6-di-t-butylphenol); 4,4'-butylidenebis(3-methyl-6-t-butylphenol); 2,2'-methylenebis(4-ethyl-6-t-butylphenol); 2,2'-methylenebis(4-methyl-6-t-butylphenol); 4,4'-isopropylidenebisphenol; 2,4-dimethyl-6-t-butylphenol; tetorakis [methylene-3-(3,5-di-t-butyl-4-hydroxyphenyl)propionate] methane; 1,1,3-tris(2-methyl-4-hydroxy-5-t-butylphenyl) butane; 1,3,5-trimethyl-2,4,6-tris(3,5-di-t-butyl-4-hydroxybenzyl)benzene; and 2,6-di-t-butyl-4-ethylphenol.

Examples of the sulfur-based antioxidant are: dialkyl thiodipropionate; a dialkyldithiocarbamate derivative (except metal salt); bis(3,5-di-t-butyl-4-hydroxybenzyl)sulfide; mercaptobenzothiazole; a reaction product of phosphorus pentasulfide and olefin; and dicetyl sulfide.

The above-described various antioxidants are respectively used singularly or in a combination of two or more. Particularly, the amine-based antioxidant, the phenol-based antioxidant, zinc alkyldithio phosphate and the like are preferably used. These antioxidants are preferably added at a rate of 0.05 to 3 mass % relative to the total amount of the composition.

Examples of the antiwear agent are: a metal thiophosphate (Zn, Pb, Sb or the like), a metal thiocarbamate (Zn or the like), a sulfur compound, phosphate ester (tricresyl phosphate), and phosphite ester, which are generally used at a rate of 0.05 to 5 mass %.

As the metal deactivator, one or a combination of two or more of benzotriazole, thiadiazole and the like is used. The metal deactivator is preferably added at a rate of 0.01 to 5 mass % relative to the total amount of the composition.

As the antifoaming agent, one or a combination of two or more of a silicone compound, an ester compound and the like is used. The antifoaming agent is preferably added at a rate of 0.05 to 5 mass % relative to the total amount of the composition.

As the pour point depressant, polymethacrylate or the like is used. The pour point depressant is preferably added at a rate of 0.01 to 10 mass % relative to the total amount of the composition.

As the surfactant, polyoxyethylene alkyl phenyl ether or the like is used. The surfactant is preferably added at a rate of 0.01 to 10 mass % relative to the total amount of the compound.

EXAMPLES

Next, the invention will be described in detail with reference to Examples and Comparatives. Incidentally, the invention is not limited to descriptions on the Examples and the like.

Examples 1 to 2 and Comparatives 1 to 5

Lubricating oil compositions of blending ratios shown in Table 1 were prepared and friction coefficient between metals and seizure load were measured to evaluate torque transmission capacity and seizure resistance. Results thereof are also shown in Table 1.

Friction Coefficient between Metals: LFW-1 Test

The friction coefficient between metals was measured using a block-on-ring tester (LFW-1) described in ASTM D2174. Specific testing conditions are as follows:

Test jig

Test pin: SUJ-2

Test block: SKH51

Conditions of main test

Oil temperature: 110 degrees C.

Sliding velocity: 0.1 m/s

Load measurement: without conducting a break-in, load was continuously increased under a condition of 42 N/min to measure the seizure load.

TABLE 1

| | | | | Example 1 | Example 2 | Comparative 1 | Comparative 2 | Comparative 3 | Comparative 4 | Comparative 5 |
|---|---|---|---|---|---|---|---|---|---|---|
| blending ratio (mass %) | base oil | | mineral oil (API category group III) | rest | rest | rest | rest | rest | rest | rest |
| | pour point depressant | | PMA (Mw 100,000) | 0.30 | 0.30 | 0.30 | 0.30 | 0.30 | 0.30 | 0.30 |
| | viscosity index improver | | PMA (Mw 10,000) | 4.00 | 2.50 | 8.20 | 8.20 | 8.20 | 4.00 | 4.00 |
| | antioxidant | | diphenylamine | 1.30 | 1.30 | — | 1.30 | 1.30 | 1.30 | 1.30 |
| | antiwear agent | | tricresyl phosphate | 0.30 | 0.30 | 0.30 | 0.30 | 0.30 | 0.30 | 0.30 |
| | ashless dispersant | | boron-modified polybutenyl succinimide (Mn 1,000 of PB group) | 1.00 | 1.00 | — | — | — | 1.00 | 1.00 |
| | | | polybutenyl succinimide (Mn 4,000 of PB group) | 4.00 | 4.00 | — | 4.00 | — | 4.00 | 4.00 |
| | metal detergent | | calcium sulfonate (400TBN) | 0.20 | 0.20 | — | — | — | 0.20 | 0.20 |
| | extreme pressure agent | | acid dithiophosphate ester[1)] | 0.10 | 0.10 | — | — | — | — | — |
| | | | phosphate ester[2)] | — | — | — | — | — | — | 0.20 |
| | coloring agent | | azo compound (Automate Red) | 0.03 | 0.03 | 0.03 | 0.03 | 0.03 | 0.03 | 0.03 |
| | antifoaming agent | | dimethylpolysiloxane | 0.20 | 0.20 | 0.20 | 0.20 | 0.20 | 0.20 | 0.20 |
| compound properties | kinematic viscosity | @40° C. | — | 37.7 | 29.1 | 28.7 | 35.7 | 28.8 | 37.6 | 35.6 |
| | | @100° C. ($mm^2/s$) | — | 7.3 | 5.9 | 6.2 | 7.2 | 6.2 | 7.3 | 7.0 |
| | viscosity index | | — | 164 | 154 | 172 | 171 | 172 | 163 | 163 |
| | metal (mass %) | Ca | — | 0.03 | 0.03 | 0.00 | 0.00 | 0.00 | 0.03 | 0.03 |
| | | P | — | 0.04 | 0.04 | 0.00 | 0.03 | 0.03 | 0.03 | 0.04 |
| | | S | — | 0.05 | 0.05 | 0.02 | 0.03 | 0.03 | 0.03 | 0.02 |
| | | B | — | 0.02 | 0.02 | 0.00 | 0.01 | 0.01 | 0.02 | 0.02 |
| | | N | — | 0.11 | 0.11 | 0.00 | 0.09 | 0.03 | 0.11 | 0.11 |
| evaluation results | LFW-1 | — | — | 0.130 | 0.139 | 0.099 | 0.120 | 0.115 | 0.120 | 0.129 |
| | FALEX | (N) | — | 10000 | 10000 | 3000 | 3000 | 5000 | 8000 | 8000 |

[1)]Phoslex DT-8 manufactured by Sakai Chemical Industry, Co., Ltd.

[2)]Phoslex A-18 manufactured by Sakai Chemical Industry, Co., Ltd.

Ring: Falex S-10 Test Ring (SAE4620 Steel)

Block: Falex H-60 Test Block (SAE01 Steel)

Conditions of break-in

Oil temperature: 90 degrees C.

Load: after being kept at 490N (50 kgf) for one minute, load was kept at 980N (100 kgf) for one minute, at 1470N (150 kgf) for one minute, and at 1830N (187 kgf) for 27 minutes.

Sliding velocity: kept at 0.5 m/s for 30 minutes

Conditions of main test

Oil temperature: 90 degrees C.

Load: 1830N (187 kgf)

Sliding velocity: sequentially kept at 0.5, 0.4, 0.3, 0.25, 0.2, 0.15, 0.1, 0.075, 0.05, 0.04, 0.025 and 0.01 m/s each for two minutes Friction coefficient: a measurement value obtained for 30 seconds before change in the sliding velocity Seizure resistance: FALEX test Seizure load was measured using an FALEX tester described in ASTM D3233 to evaluate seizure resistance. The seizure resistance represents extreme pressure property between steels. Specific test conditions are as follows.

[Evaluation Results]

From the Examples 1 to 2 shown in Table 1, since the lubricating oil compositions according to the invention contain acid dithiophosphate as the component (A), (boron-modified) polybutenyl succinimide as the component (B), and calcium sulfonate as the component (C), it can be understood that the lubricating oil compositions have a high friction coefficient between metals and a large torque transmission capacity. Further, it can be understood from the result of the FALEX test that the lubricating oil compositions are excellent in seizure resistance.

On the other hand, since the Comparatives 1 to 5 do not contain the above-described component (A), the friction coefficients between metals thereof are low and seizure resistances thereof are poor. Particularly, since the Comparatives 1 and 3 do not contain any one of the above-described components (A) to (C), the seizure resistances thereof are considerably poor. The Comparative 2 has boron-unmodified polybutenyl succinimide as the component (B) in addition to the components of the Comparative 3, and therefore the seizure resistance thereof is rather deteriorated while the friction coefficient between metals thereof is slightly increased.

The invention claimed is:

1. A lubricating oil composition comprising:

a base mineral oil of lubricating oil;

from 0.05 to 5 mass % of tricresyl phosphate; and components (A) to (C) below:

(A) from 0.05 to 0.5 mass % of acid dithiophosphate, (B) from 0.01 to 0.03 mass % of boron-modified polybutenyl succinimide compound in terms of boron relative to the total amount of the composition; and (C) from 0.01 to 0.05 mass % of calcium sulfonate in terms of alkaline earth metal relative to the total amount of the composition, wherein the composition exhibits properties (D) to (F) below:

(D) kinematic viscosity at 40 degrees C. of 20 to 40 $mm^2/s$;

(E) kinematic viscosity at 100 degrees C. of 4 to 8 $mm^2/s$; and (F) viscosity index of 100 to 250, wherein the lubricating oil composition exhibits a value of 0.130 or more in a friction coefficient between metals (LFW-1) according to ASTM D2174.

2. The lubricating oil composition according to claim 1, wherein the composition exhibits properties (D) to (E) below:

(D) kinematic viscosity at 40 degrees C. of 25 to 38 $mm^2/s$; and (E) kinematic viscosity at 100 degrees C. of 5 to 6 $mm^2/s$.

3. The lubricating oil composition according to claim 1, comprising from 0.05 to 0.4 mass % of the component (A) relative to a total amount of the composition.

4. The lubricating oil composition according to claim 1, comprising from 0.1 to 0.3 mass % of the component (A) relative to a total amount of the composition.

5. The lubricating oil composition according to claim 1, comprising from 0.015 to 0.025 mass % of the compound (B) in terms of boron relative to a total amount of the composition.

6. The lubricating oil composition according to claim 1, comprising from 0.015 to 0.045 mass % of the component (C) in terms of alkaline earth metal relative to a total amount of the composition.

7. The lubricating oil composition according to claim 1, comprising from 0.02 to 0.04 mass % of the component (C) in terms of alkaline earth metal relative to a total amount of the composition.

* * * * *